US011534900B2

(12) United States Patent
McNeely

(10) Patent No.: US 11,534,900 B2
(45) Date of Patent: Dec. 27, 2022

(54) APPARATUS AND METHOD FOR DISASSEMBLING A PIPE JOINT

(71) Applicant: John McNeely, Concord Township, OH (US)

(72) Inventor: John McNeely, Concord Township, OH (US)

( * ) Notice: Subject to any disclaimer, the term of this patent is extended or adjusted under 35 U.S.C. 154(b) by 0 days.

(21) Appl. No.: 17/307,245

(22) Filed: May 4, 2021

(65) Prior Publication Data

US 2021/0347021 A1 Nov. 11, 2021

Related U.S. Application Data

(60) Provisional application No. 63/020,090, filed on May 5, 2020.

(51) Int. Cl.
*B25B 27/02* (2006.01)

(52) U.S. Cl.
CPC ..... *B25B 27/023* (2013.01)

(58) Field of Classification Search
CPC ..... B23P 11/00; B23P 11/005; B23P 19/00; B25B 27/023; B25B 27/14
USPC ..... 29/251, 255, 263, 278, 280
See application file for complete search history.

(56) References Cited

U.S. PATENT DOCUMENTS 2,671,263 A * 3/1954 Hamilton ..... B25B 27/062 29/265
2,991,674 A 7/1961 Uhl
3,345,855 A * 10/1967 Franck ..... B21D 41/021 72/317
3,415,100 A * 12/1968 Britts ..... B21D 41/04 72/317
3,421,354 A * 1/1969 Strybel ..... B21D 39/06 72/317
3,466,707 A * 9/1969 Click ..... B29C 43/42 425/193
3,535,765 A * 10/1970 Denehie ..... B25B 27/24 29/888.42
3,575,033 A * 4/1971 Meyer, Jr. ..... B21D 41/021 72/317
4,127,021 A * 11/1978 Johnson ..... B21D 41/021 72/313
4,694,569 A * 9/1987 Colvell ..... B25B 27/023 29/724
4,754,634 A * 7/1988 Murata ..... B21D 17/025 72/318
5,090,102 A 2/1992 Lovell
6,199,421 B1 * 3/2001 Ploeger ..... B21D 41/021 72/317

(Continued)

*Primary Examiner* — Lee D Wilson
*Assistant Examiner* — Alberto Saenz
(74) *Attorney, Agent, or Firm* — Tarolli, Sundheim, Covell & Tummino LLP

(57) ABSTRACT

A method for disassembling a pipe joint is provided. A radially expandable sleeve positioned on a shaft is inserted into a distal open end of a pipe of the pipe joint. A sleeve nut on a threaded portion of the shaft is tightened against the sleeve to urge the sleeve to longitudinally slide along a tapered distal end of the shaft in a distal direction. The sleeve radially expands as the sleeve slides in the distal direction along the tapered distal end of the shaft. The sleeve is radially expanded until an interference fit is formed between the sleeve and the pipe. A force is then exerted upon the shaft to urge the shaft in a proximal direction and remove the pipe from a pipe fitting of the pipe joint.

20 Claims, 12 Drawing Sheets

(56) References Cited

U.S. PATENT DOCUMENTS 9,718,156 B2 8/2017 Whitaker

* cited by examiner

APPARATUS AND METHOD FOR DISASSEMBLING A PIPE JOINT

RELATED APPLICATION

This application claims priority from U.S. Provisional Application No. 63/020,090, filed 5 May 2020, the subject matter of which is incorporated herein by reference in its entirety.

TECHNICAL FIELD

This disclosure relates to an apparatus for disassembling a pipe joint and a method for use of the apparatus to disassemble a pipe joint.

BACKGROUND

In certain situations, it can be desirable to disassemble a pipe joint. Certain pipe joints include a pipe inserted into an open end of a pipe fitting. Once the pipe is inserted into the pipe fitting, a pressing tool is placed around the pipe fitting and is actuated to radially compress the pipe fitting. The compressed pipe fitting forms a press-fit engagement between the pipe fitting and the pipe. This press-fit engagement can provide difficulties when disassembling the pipe joint. Further, after the pipe joint is disassembled, it may be desirable to reuse the pipe fitting. However, because the pipe fitting has been radially compressed to form the pipe joint, the pipe fitting may need to be swaged prior to reuse.

SUMMARY

In an aspect, a method for disassembling a pipe joint is provided. The method includes providing an apparatus for disassembling a pipe joint. The apparatus includes a shaft having a threaded portion longitudinally proximal to an outwardly tapered distal end. A radially expandable sleeve defines a longitudinally oriented lumen through which the shaft extends. A sleeve nut is threadedly attached to the threaded portion of the shaft adjacent to a proximal end of the sleeve. The sleeve is inserted into a distal open end of a pipe of the pipe joint. After inserting the sleeve into the distal open end of the pipe, the sleeve nut is tightened on the threaded portion of the shaft against the sleeve to urge the sleeve to longitudinally slide along the tapered distal end of the shaft in a distal direction. The sleeve radially expands as the sleeve slides in the distal direction along the tapered distal end of the shaft.

In an aspect, an apparatus for disassembling a pipe joint is provided. The apparatus includes a shaft having a threaded portion longitudinally proximal to an outwardly tapered distal end. A radially expandable sleeve is configured to be inserted into a distal end of a pipe of the pipe joint. The radially expandable sleeve defines a longitudinally oriented lumen through which the shaft extends. A sleeve nut is threadedly attached to the threaded portion of the shaft adjacent to a proximal end of the sleeve. Selective tightening of the sleeve nut on the threaded portion of the shaft against the sleeve urges the sleeve to longitudinally slide along the tapered distal end of the shaft. The sleeve radially expands as the sleeve longitudinally slides along the tapered distal end of the shaft. The sleeve has an interference fit with the pipe when expanded.

BRIEF DESCRIPTION OF THE DRAWINGS

For a better understanding, reference may be made to the accompanying drawings, in which.

DETAILED DESCRIPTION OF THE INVENTION

Unless defined otherwise, all technical and scientific terms used herein have the same meaning as is commonly understood by one of ordinary skill in the art to which the present disclosure pertains.

As used herein, the term "user" can be used interchangeably to refer to an individual who prepares for, assists with, and/or performs the operation of a tool.

As used herein, the singular forms "a," "an" and "the" can include the plural forms as well, unless the context clearly indicates otherwise. It will be further understood that the terms "comprises" and/or "comprising," as used herein, can specify the presence of stated features, steps, operations, elements, and/or components, but do not preclude the presence or addition of one or more other features, steps, operations, elements, components, and/or groups thereof.

As used herein, the term "and/or" can include any and all combinations of one or more of the associated listed items.

As used herein, phrases such as "between X and Y" can be interpreted to include X and Y.

It will be understood that when an element is referred to as being "on," "attached" to, "connected" to, "abutting," etc., another element, it can be directly on, attached to, connected to or abutting the other element or intervening elements may also be present. It will also be appreciated by those of skill in the art that references to a structure or feature that is disposed "adjacent" another feature may not have portions that overlap or underlie the adjacent feature.

Spatially relative terms, such as "proximal," "distal" and the like, may be used herein for ease of description to describe one element or feature's relationship to another element(s) or feature(s) as illustrated in the Figures. It will be understood that the spatially relative terms can encompass different orientations of a device in use or operation, in addition to the orientation depicted in the Figures. For example, if a device in the Figures is inverted, elements described as "proximal" to other elements or features would then be oriented "distal" to the other elements or features.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or Figures unless specifically indicated otherwise.

The invention comprises, consists of, or consists essentially of the following features, in any combination.

Figure 1:
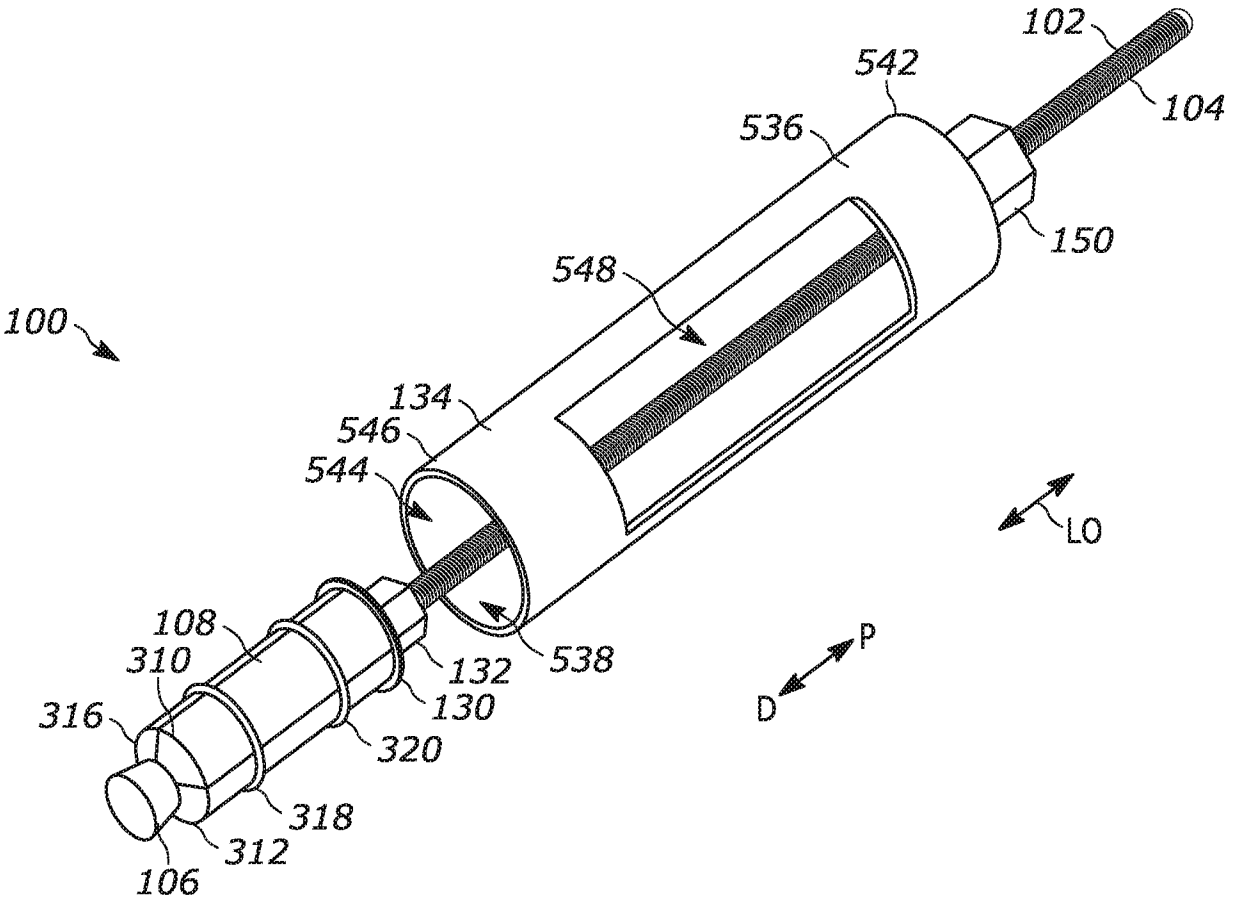
FIG. 1 is a perspective side view of an apparatus for disassembling a pipe joint according to one aspect of the present invention.
Figure 2:
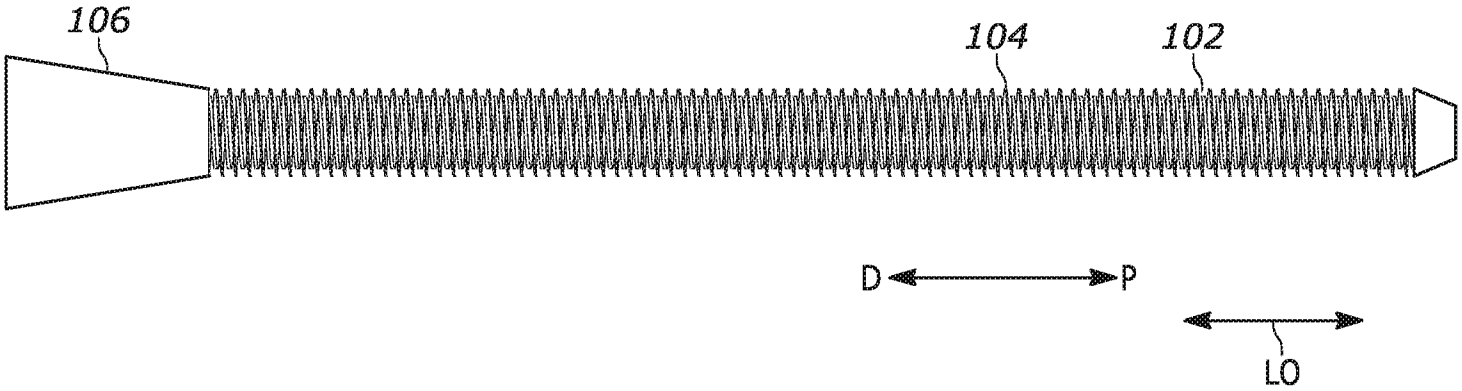
FIG. 2 is a side view of an element of the aspect of FIG. 1.

FIG. 1 depicts an example configuration of an apparatus 100 for disassembling a pipe joint. As shown in FIGS. 1-2, the apparatus 100 includes a shaft 102 having a threaded portion 104 longitudinally proximal to an outwardly tapered distal end 106. The term "longitudinal" is used herein to indicate a substantially horizontal direction, in the orientation of FIG. 2, and is indicated at "LO" in FIG. 2. The term "taper" is defined herein as a gradual increase in thickness, diameter, or width in an elongated object, as is shown by the gradual increase in diameter of the distal end 106 in FIG. 2. The term "outward" is defined herein as a taper that becomes gradually larger, such as shown as the gradual increase in diameter moving along the distal end 106 in the longitudinal direction away from the threaded portion 104 in FIG. 2. Further, the outward taper, such as the taper of the distal end 106, could include any desired diminution in diameter (or inward taper) distal to the threaded portion 104.

Figure 3:
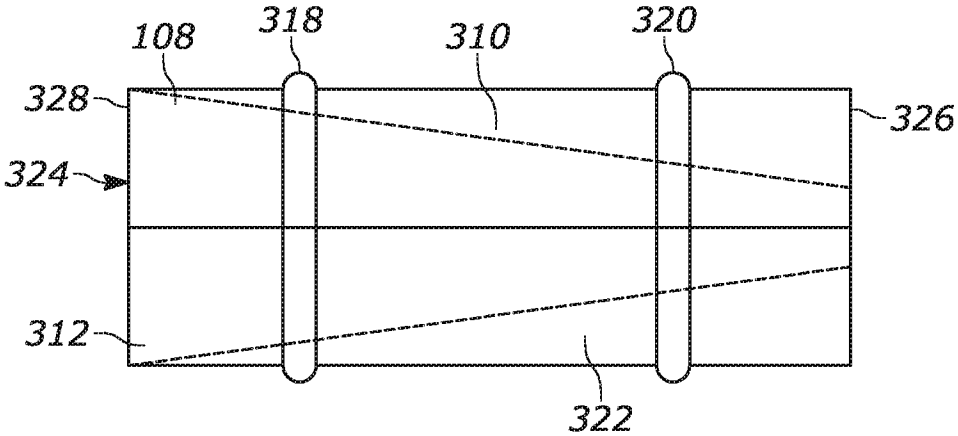
FIG. 3 is a side view of an element of the aspect of FIG. 1.
Figure 4:
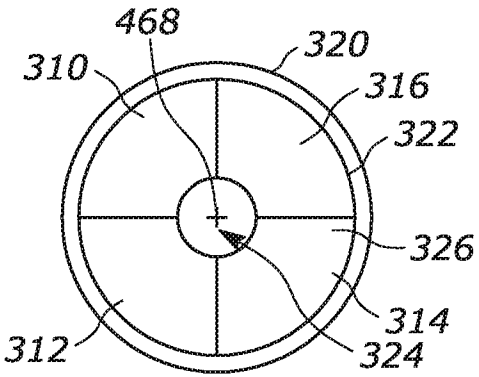
FIG. 4 is a rear view of the element of the aspect of FIG. 3.

As shown in FIG. 1, selectively provided on the shaft 102 is a radially expandable sleeve 108. As shown in FIGS. 3-4, the sleeve 108 includes a plurality of arcuate wedges 310, 312, 314, 316 that are biased mutually together by one or more biasing members 318, 320, such as one or more elastic bands, extending about an outer surface 322 of the sleeve. The arcuate wedges 310, 312, 314, 316 cooperatively define a longitudinally oriented lumen 324 through which the shaft 102 can selectively extend. As shown in FIG. 3, the lumen 324 can be outwardly tapered from a proximal end 326 of the sleeve 108 to a distal end 328 of the sleeve. This outwardly tapered configuration of the lumen 324 may provide for a better interface with the tapered distal end 106 of the shaft 102 than if the lumen were not outwardly tapered.

Returning to FIG. 1, the sleeve 108 can be selectively maintained on the shaft 102 through the help of a washer 130 and a sleeve nut 132. The washer 130 and the sleeve nut 132 are attached, such as threadedly attached, to the threaded portion 104 of the shaft 102 adjacent to the proximal end 326 of the sleeve 108, and thus selectively prevent the egress of the sleeve from the shaft in the proximal direction P. The tapered distal end 106 of the shaft 102 helps prevent the sleeve 108 from separating from the shaft via movement of the sleeve 108 in the distal direction D. Therefore, the sleeve 108 is selectively maintained on the shaft 102 during use, but can be removed in the proximal direction P when desired.

Figure 5:
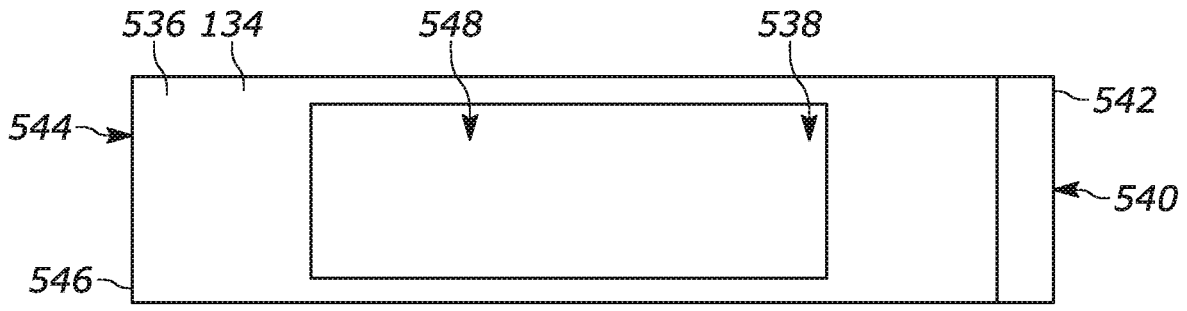
FIG. 5 is a side view of an element of the aspect of FIG. 1.

The apparatus 100 shown in FIG. 1 can also include a housing 134. As shown in FIG. 5, the housing 134 has a cylindrically shaped sidewall 536 that defines an interior space 538 of the housing. The interior space 538 longitudinally extends from an opening 540 in a proximal end 542 of the housing 134 to an opening 544 in a distal end 546 of the housing. The shaft 102 can be inserted through the proximal opening 540 to attach the housing 134 to the shaft. The attached housing 134 can be selectively positioned on the shaft 102 so that at least a portion of the shaft, the sleeve 108, and the sleeve nut 132 are located within the interior space 538. An opening 548 in the sidewall 536 can permit a user to view portions of the apparatus 100 that are selectively located within the housing 134. By visually accessing these interior portions of the apparatus 100, the user can quickly identify if the apparatus is functioning as desired.

As shown in FIG. 1, the housing 134 can be selectively maintained on the shaft 102 through the help of a housing nut 150. The housing nut 150 can be threadedly attached to the threaded portion 104 of the shaft 102 adjacent to the proximal opening 540 of the housing 134, and thus can selectively prevent the egress of the housing from the shaft in the proximal direction P. The sleeve nut 132 can be configured to be larger than the proximal opening 540 of the housing 134 in order to help prevent the housing from separating from the shaft 102 via movement of the housing 134 in the distal direction D. Therefore, the housing 134 is selectively maintained on the shaft 102 during use, but can be removed in the proximal direction P when desired. A washer 952 (see FIG. 9) can be attached to the threaded portion 104 of the shaft 102 between the housing nut 150 and the proximal end 542 of the housing 134.

Figure 6:
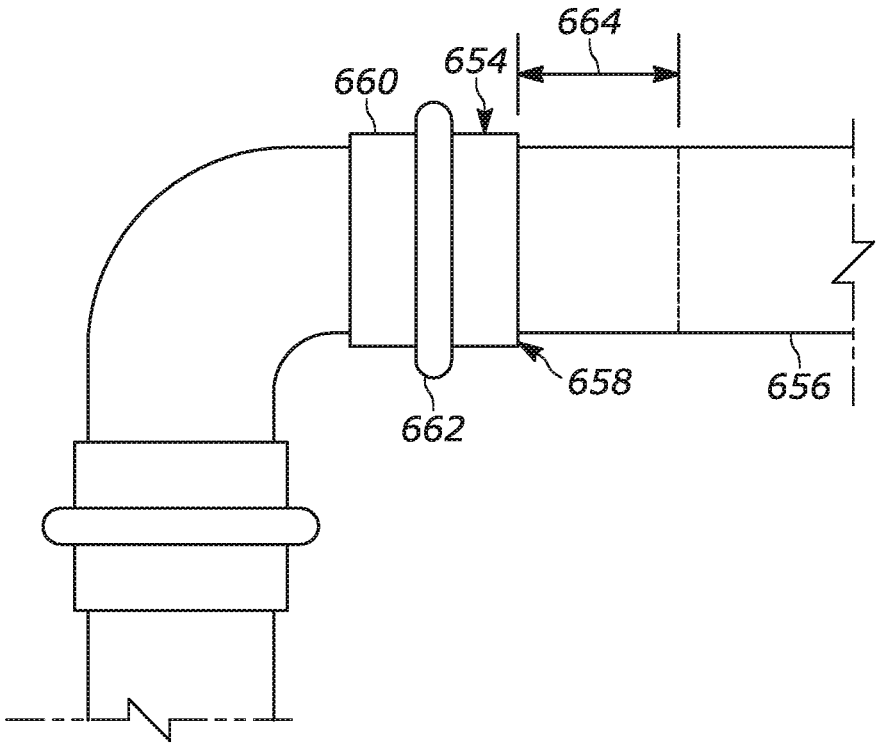
FIGS. 6-11 schematically illustrate an example sequence of operation of a portion of the aspect of FIG. 1.

FIG. 6 depicts a pipe joint 654 which is to be disassembled. An example process for forming the pipe joint 654 of FIG. 6 in the first place, before disassembly is desired, includes insertion of the pipe 656 into an distal open end 658 of a pipe fitting 660. A pressing tool (not shown) is placed around a portion of the pipe fitting 660 including a radial projection 662, and is actuated to radially compress the pipe fitting 660. The compressing process creates a press-fit engagement between the pipe fitting 660 and the pipe 656. The radial projection 662 can include an o-ring (not shown) associated therewith to help form an airtight seal between the pipe 656 and the pipe fitting 660. In this manner, the pipe joint 654 is created and can be maintained for a desired length of time until disassembly is desired.

Figure 7:
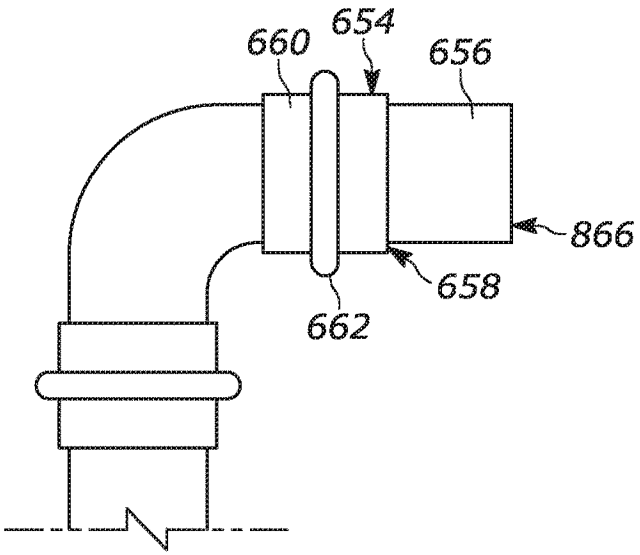
Figure 8:
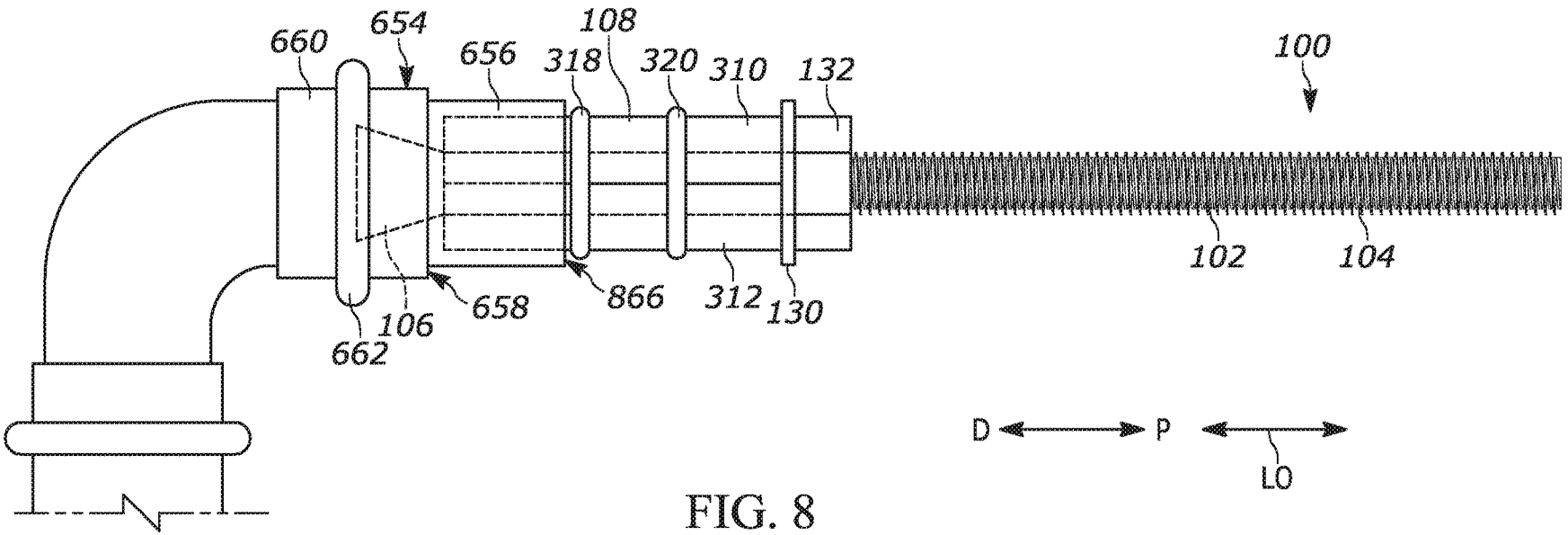

Disassembling a previously formed pipe joint 654, such as the one depicted in FIG. 6, can be difficult due to the previously mentioned press-fit engagement between the pipe fitting 660 and the pipe 656. The apparatus 100, however, is configured to disassemble such a pipe joint 654. For disassembly of the pipe joint 654, as shown in FIGS. 6-7, the pipe 656 is cut at a desired length 664, such as, but not limited to, one inch, from the distal open end 658 of the pipe fitting 660. The shaft 102, sleeve 108, sleeve nut 132, and washer 130 of the apparatus 100 are assembled as described above. As shown in FIG. 8, the sleeve 108 is inserted into a distal open end 866 of the cut pipe 656. The sleeve nut 132 is then selectively tightened on the threaded portion 104 of the shaft 102 against the sleeve 108. The tightening of the sleeve nut 132 urges the sleeve 108 to longitudinally slide along the tapered distal end 106 of the shaft 102 in the distal direction D.

The tapered distal end 106 of the shaft 102 urges the arcuate wedges 310, 312, 314, 316 to move radially away from a sleeve axis 468 (see FIG. 4) against the bias of the biasing members 318, 320 as the sleeve 108 longitudinally slides along the tapered distal end of the shaft. The radial movement of the arcuate wedges 310, 312, 314, 316 away from the sleeve axis 468 causes the sleeve 108 to radially expand. The sleeve nut 132 is tightened and the sleeve 108 radially expanded until an interference fit is formed between the sleeve and the pipe 656.

Figure 9:
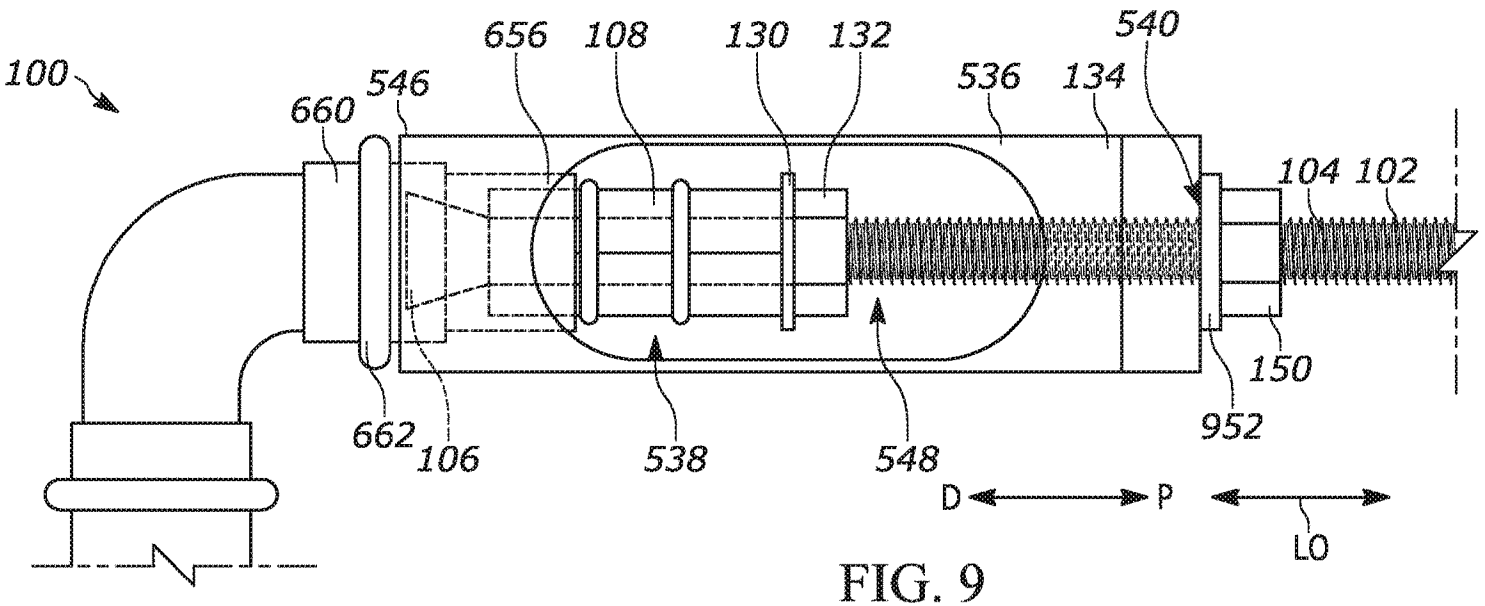

Once there is an interference fit between the sleeve 108 and the pipe 656, the housing 134 can be attached to the shaft 102 by longitudinally inserting the shaft through the interior space 538 and the proximal opening 540 of the housing. The housing 134 is then slid along the shaft 102 and positioned so that the distal end 546 of the housing engages the radial projection 662 on the pipe fitting 660. As shown in FIG. 9, when the housing 134 reaches this desired position, at least a portion of the shaft 102, the sleeve 108, the sleeve nut 132, and the washer 130 are selectively located within the interior space 538.

The housing nut 150 is then threadedly attached to the shaft 102 and positioned adjacent to the proximal opening 540 of the housing 134. As shown in FIG. 9, a washer 952 can also be attached to the shaft 102 and positioned between the housing nut 150 and the proximal end 542 of the housing 134 to spread forces evenly across the proximal end of the housing. The housing nut 150 is tightened on the threaded portion 104 of the shaft 102 against the housing 134. Because the housing 134 is prevented from longitudinally moving in the distal direction D by the radial projection 662 of the pipe fitting 660, tightening the housing nut 150 causes a force to be exerted on the shaft 102 that longitudinally urges the shaft, along with the sleeve 108, the sleeve nut 132, and the washer 130 connected thereto, in the proximal direction P. The interference fit between the sleeve 108 and the pipe 656 causes the pipe to be pulled from the pipe fitting 660 as the shaft 102 is urged in the proximal direction P.

Figure 10:
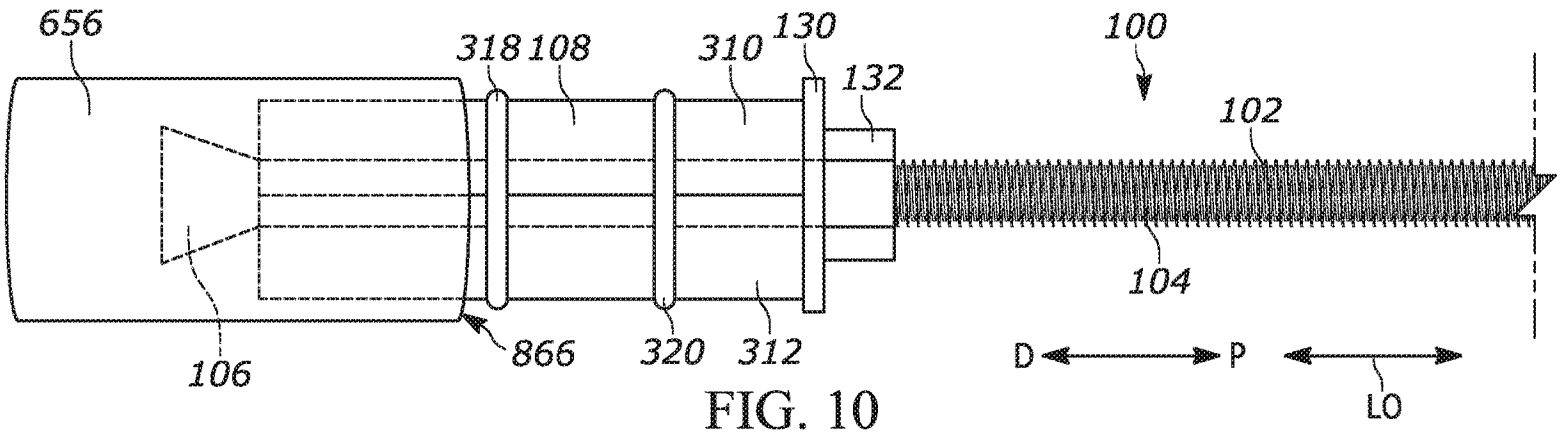

The user can look through the opening 548 in the sidewall 536 of the housing 134 to verify that the pipe 656 has been pulled from the pipe fitting 660 after performing the above-described sequence of actions. As shown in FIG. 10, once the pipe 656 is pulled, the housing 134, the housing nut 150, and the washer 130 are removed from the shaft 102. The sleeve nut 132 is then loosened on the threaded portion 104 of the shaft 102 to permit the sleeve 108 to longitudinally slide along the tapered distal end 106 of the shaft in the proximal direction P. The bias of the biasing members 318, 320 urges the sleeve 108 to radially contract as the sleeve slides in the proximal direction P. The interference fit between the sleeve 108 and the pipe 658 ceases once the sleeve is contracted, so that the sleeve can be removed from the distal open end 866 of the pipe.

If desired, the pipe fitting 660 can be prepared for reuse once the pipe 656 has been pulled from the pipe fitting. Because the pipe fitting 660 has been radially compressed to form the pipe joint 654, the pipe fitting may need to be swaged before reuse. As will be described below, the apparatus 100 can also be used to swage the pipe fitting 660. Prior to swaging, any o-ring located within the radial projection 662 may be removed from the radial projection and inspected for damage, then re-placed as desired, or a different o-ring could be provided.

Figure 11:
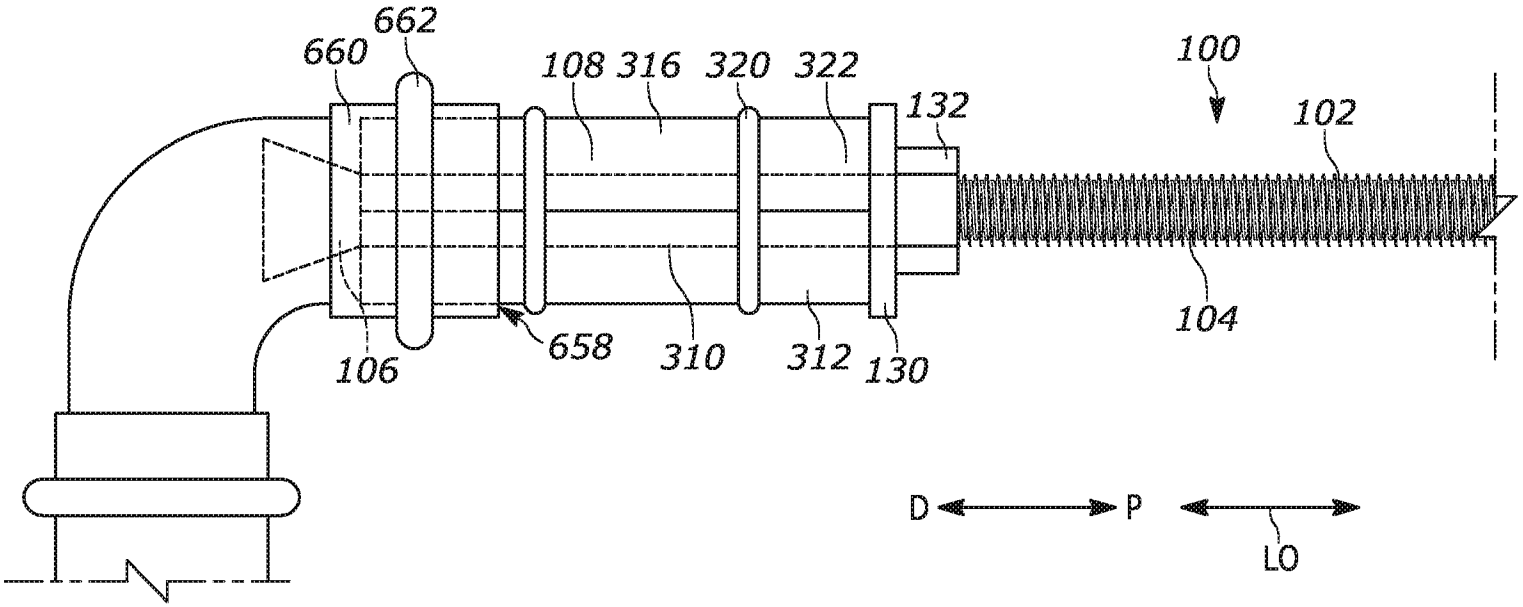

As shown in FIG. 11, the sleeve 108, which is contracted and removed from the pipe 656, is inserted into the distal open end 658 of the pipe fitting 660. The sleeve nut 132 is then tightened on the shaft to cause the sleeve 108 to radially expand in a similar manner as described above. Radially expanding the sleeve 108 causes the outer surface 322 of the sleeve to press against the distal open end 658 of the pipe fitting 660 and swage the pipe fitting. The sleeve 108 can be radially expanded until the pipe fitting 660 is swaged. Further, the sleeve 108 can be contracted in a similar manner as described above, rotated in place, and re-expanded at a different radial position to help evenly swage the distal open end 658 of the pipe fitting 660. Once the pipe fitting 660 has been swaged, the o-ring can be reinserted into the radial projection 662, if desired, or a new, replacement o-ring can be inserted into the radial projection 662. With the pipe fitting 660 swaged and any o-ring in place, the pipe fitting 660 can be reused as desired.

Figure 12:
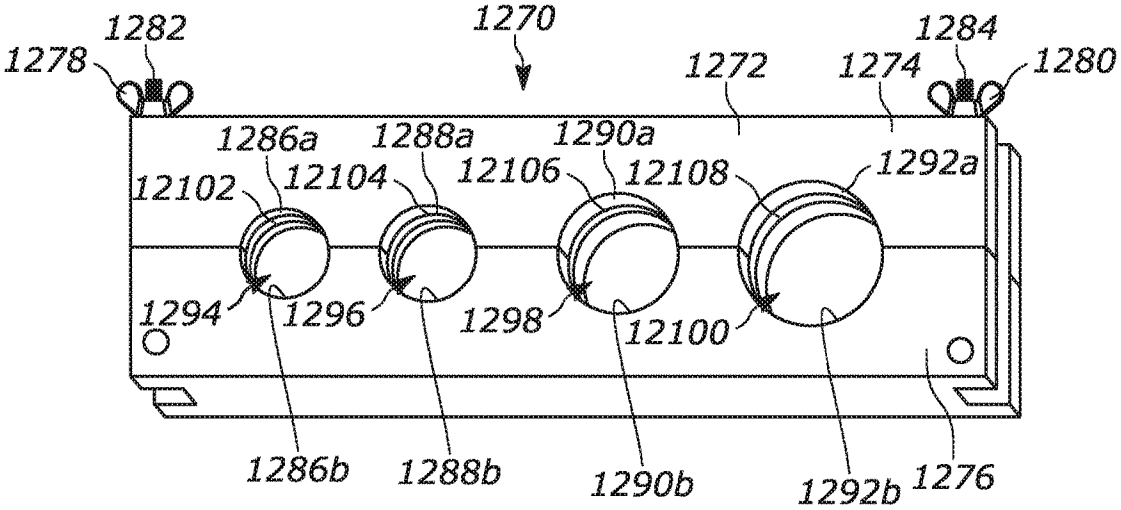
FIG. 12 is a perspective front view of an element of an apparatus for disassembling a pipe joint according to a second aspect of the present invention.
Figure 13:
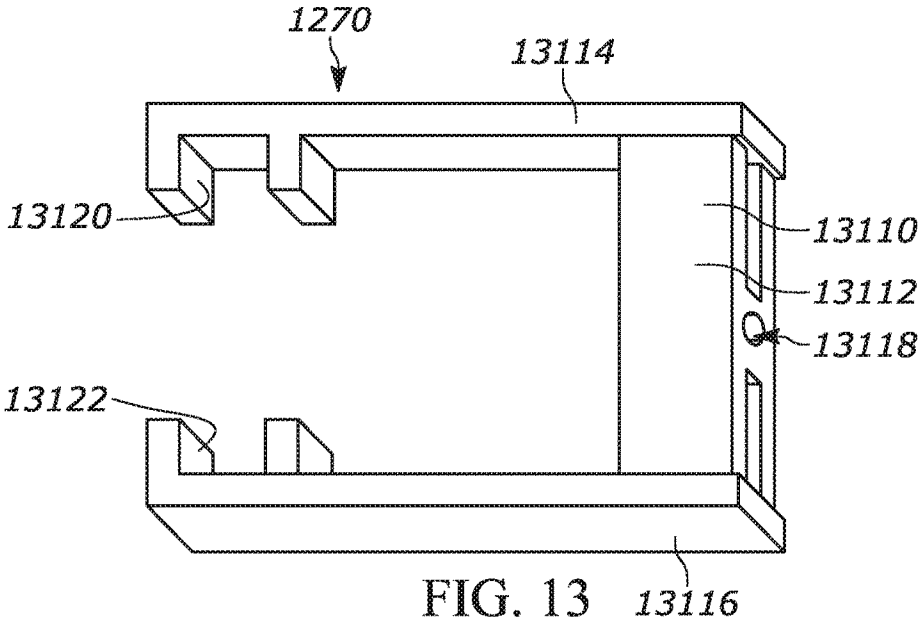
FIG. 13 is a perspective side view of an element of the aspect of FIG. 12.
Figure 14:
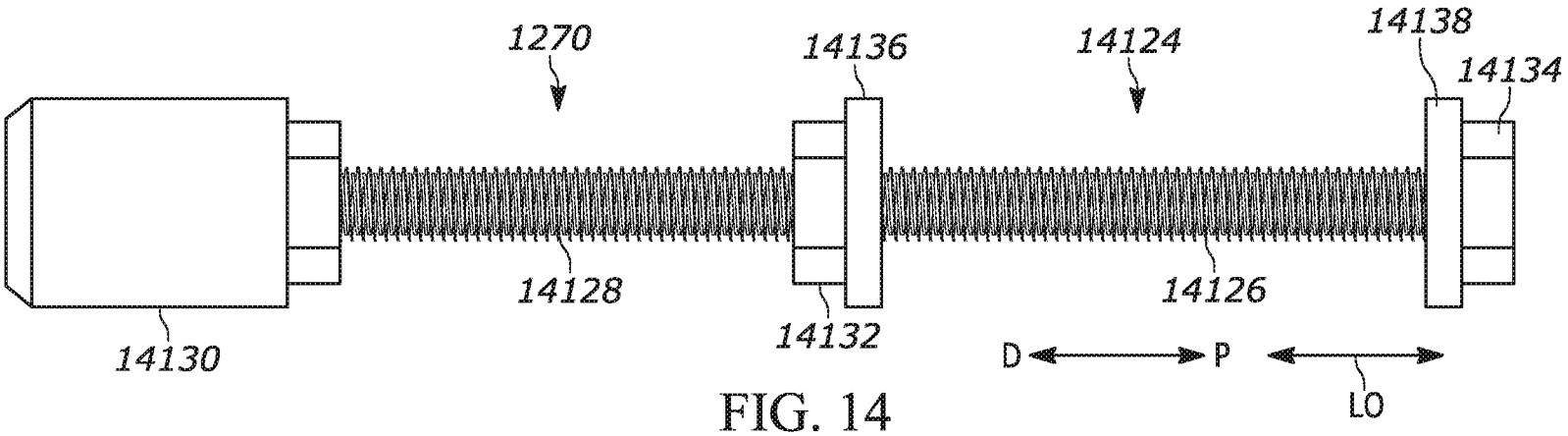
FIG. 14 is a side view of an element of the aspect of FIG. 12.

FIGS. 12-14 illustrate a second configuration of an apparatus 1270 for disassembling a pipe joint. The apparatus 1270 of FIGS. 12-14 is similar to the apparatus 100 of FIGS. 1-5 and therefore, structures of FIGS. 12-14 that are the same as or similar to those described with reference to FIGS. 1-5 have the same reference numbers. Description of common elements and operation similar to those in the previously described first configuration will not be repeated with respect to the second configuration, but should instead be considered to be incorporated below by reference as appropriate.

FIG. 12 depicts a clamp 1272 having first and second clamp plates 1274, 1276. Nuts 1278, 1280 selectively attached to threaded bolts 1282, 1284 can selectively hold the first and second clamp plates 1274, 1276 abutting one another. Clamping surfaces 1286*a*, 1288*a*, 1290*a*, 1292*a* on the first clamp plate 1274 are each presented toward an associated clamping surface 1286*b*, 1288*b*, 1290*b*, 1292*b* on the second clamp plate 1276 when the first and second clamp plates abut one another. Each of the associated pairs of clamping surfaces 1286*a-b*, 1288*a-b*, 1290*a-b*, 1292*a-b* defines a clamp opening 1294, 1296, 1298, 12100 that is configured to hold a pipe fitting 660 of a different diameter than any of the other clamp openings. Being able to hold pipe fittings 660 of various sizes with a single clamp 1272 helps prevent a user from having to carry multiple clamps for disassembling a pipe joint 654. Although the clamp 1272 is shown having four clamp openings 1294, 1296, 1298, 12100, the clamp can have any desired number of clamp openings.

In order to better interface with a pipe fitting 660 that has a radial projection 662, the clamp 1272 can have grooves 12102, 12104, 12106, 12108 that each radially extend into the first and second clamp plates 1274, 1276 from each of the clamping surfaces 1286*a-b*, 1288*a-b*, 1290*a-b*, 1292*a-b*. Each of the grooves 12102, 12104, 12106, 12108 are configured to hold a radial projection 662 of a correspondingly sized pipe fitting 660. The grooves 12102, 12104, 12106, 12108 may also help hold a pipe fitting 660 within an associated clamp opening 1294, 1296, 1298, 12100. For example, a radial projection 662 of a pipe fitting 660 that is being urged to slide out of an associated clamp opening 1294, 1296, 1298, 12100 would be pressed into the walls of an associated groove 12102, 12104, 12106, 12108, to help prevent the pipe fitting from sliding out of the clamp opening.

FIG. 13 depicts a yoke 13110 of the apparatus 1270. The yoke 13110 has a yoke body 13112 that interconnects opposing first and second yoke arms 13114, 13116. The yoke body 13112 has a yoke opening 13118 through which the shaft 102 can be inserted to attach the yoke 13110 to the shaft. The first yoke arm 13114 has a first clamp grip 13120 that is configured to hold the first clamp plate 1274. The second yoke arm 13116 has a second clamp grip 13122 that is configured to hold the second clamp plate 1276.

Similar to the apparatus 100 of the first configuration, the apparatus 1270 of the second configuration can be used to swage an open distal end 658 of a pipe fitting 660 after a pipe 656 has been pulled therefrom. However, instead of, or in addition to, using the sleeve 108 to swage the distal open end 658 of the pipe fitting 660, the apparatus 1270 can include a separate swage tool 14124. As shown in FIG. 14, the swage tool 14124, when present, includes a swage shaft 14126 having a threaded portion 14128 longitudinally proximal to a cylindrical swage end 14130. The swage end 14130 is configured to selectively swage a distal open end 658 of a pipe fitting 660. The swage tool 12124 also includes first and second swage nuts 14132, 14134 selectively threadedly attached to the threaded portion 14128 of the swage shaft 14126. Washers 14136, 14138 can also be selectively attached to the threaded portion 14128 of the swage shaft 14126 and positioned adjacent to the first and second swage nuts 14132, 14134.

Figure 15:
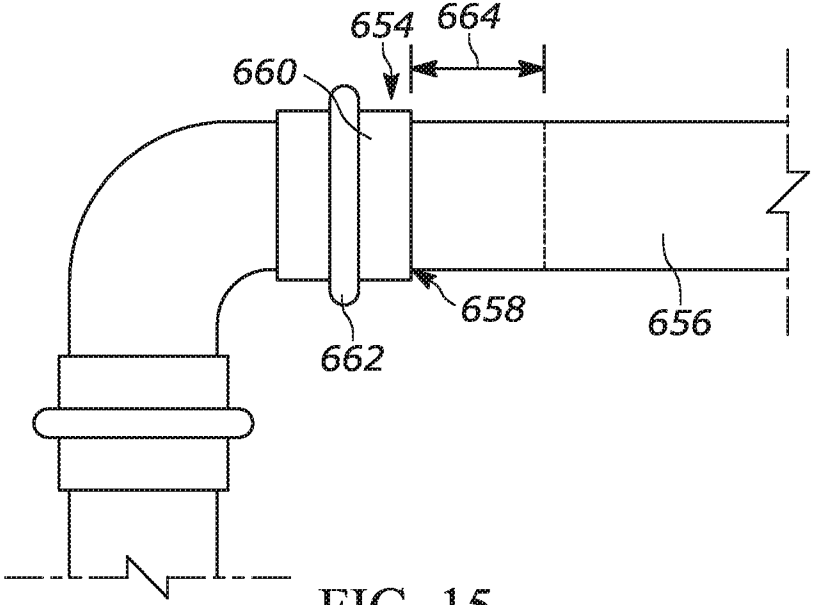
FIGS. 15-20 schematically illustrate an example sequence of operation of a portion of the aspect of FIG. 12.
Figure 16:
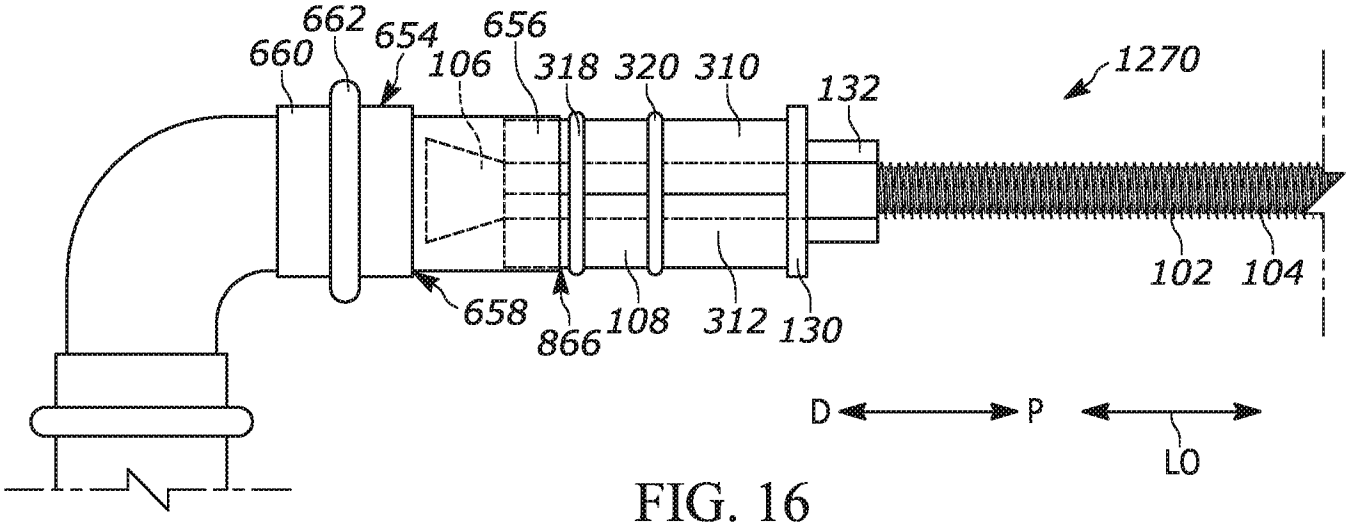

FIG. 15 depicts a pipe joint 654 which is to be disassembled, and which was previously constructed in substantially the same manner as the pipe joint 654 depicted in FIG. 6. To disassemble the pipe joint 654, as shown in FIG. 15, a pipe 656 is cut at a desired length 664, such as, but not limited to, one inch, from the distal open end 658 of a pipe fitting 660. The shaft 102, sleeve 108, sleeve nut 132, and washer 130 of the apparatus 100 are assembled as described above. As shown in FIG. 16, the sleeve 108 is inserted into a distal open end 866 of the cut pipe 656. The sleeve 108 is then radially expanded in the same manner as described above until an interference fit is formed between the sleeve and the pipe 656.

Figure 17:
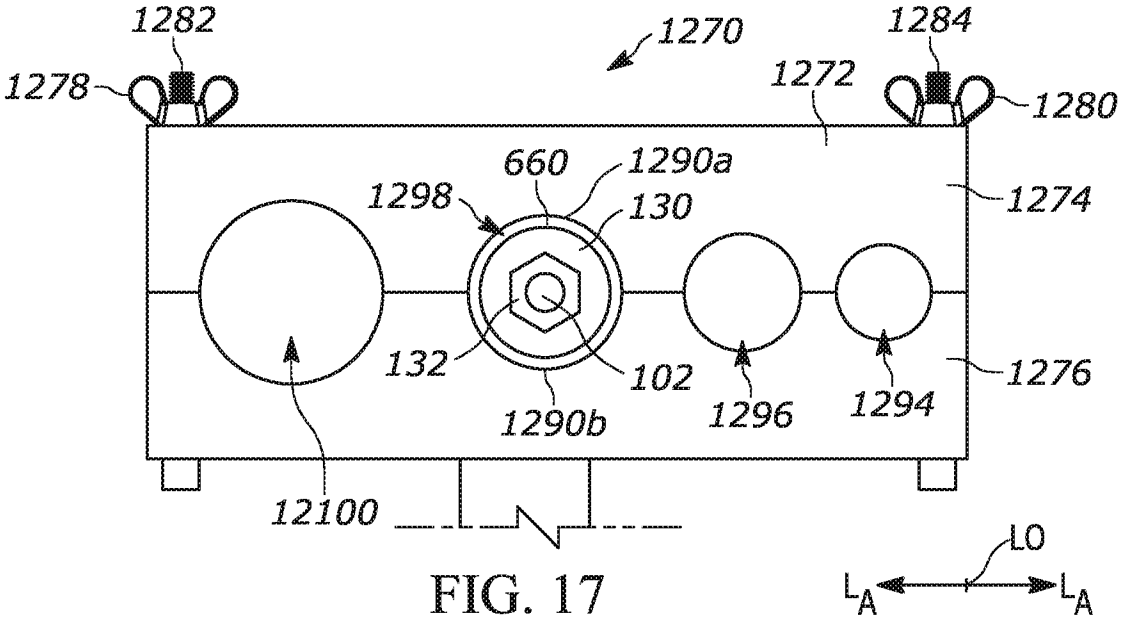

Once there is an interference fit between the sleeve 108 and the pipe 656, the user can determine the size of the pipe fitting 660. The user then determines which clamp opening 1294, 1296, 1298, 12100 of the clamp 1272 to use, based on the size of the pipe fitting 660. The correspondingly sized clamping surfaces 1290*a*, 1290*b* of the first and second clamp plates 1274, 1276 are positioned about the pipe fitting 660 to position the pipe fitting within an appropriately sized clamp opening 1298 and the radial projection 662 within the groove 12104. As shown in FIG. 17, the first clamp plate 1274 is then secured to the second clamp plate 1276 via the nuts 1278, 1280 and the threaded bolts 1282, 1284 to maintain the pipe fitting 660 in the associated clamp opening 1298. The clamp 1272 extends in the lateral direction when attached to the pipe fitting 660. The term "lateral" is used herein to indicate a direction substantially perpendicular to the "longitudinal" direction, and is indicated at "LA" in FIG. 17. Although the clamp 1272 has been characterized as being attached to the pipe fitting 660 after the sleeve 108 is inserted into the cut pipe 656, the clamp 1272 could instead be attached to the pipe fitting 660 prior to the insertion of the sleeve 108 into the cut pipe 656.

Figure 18:
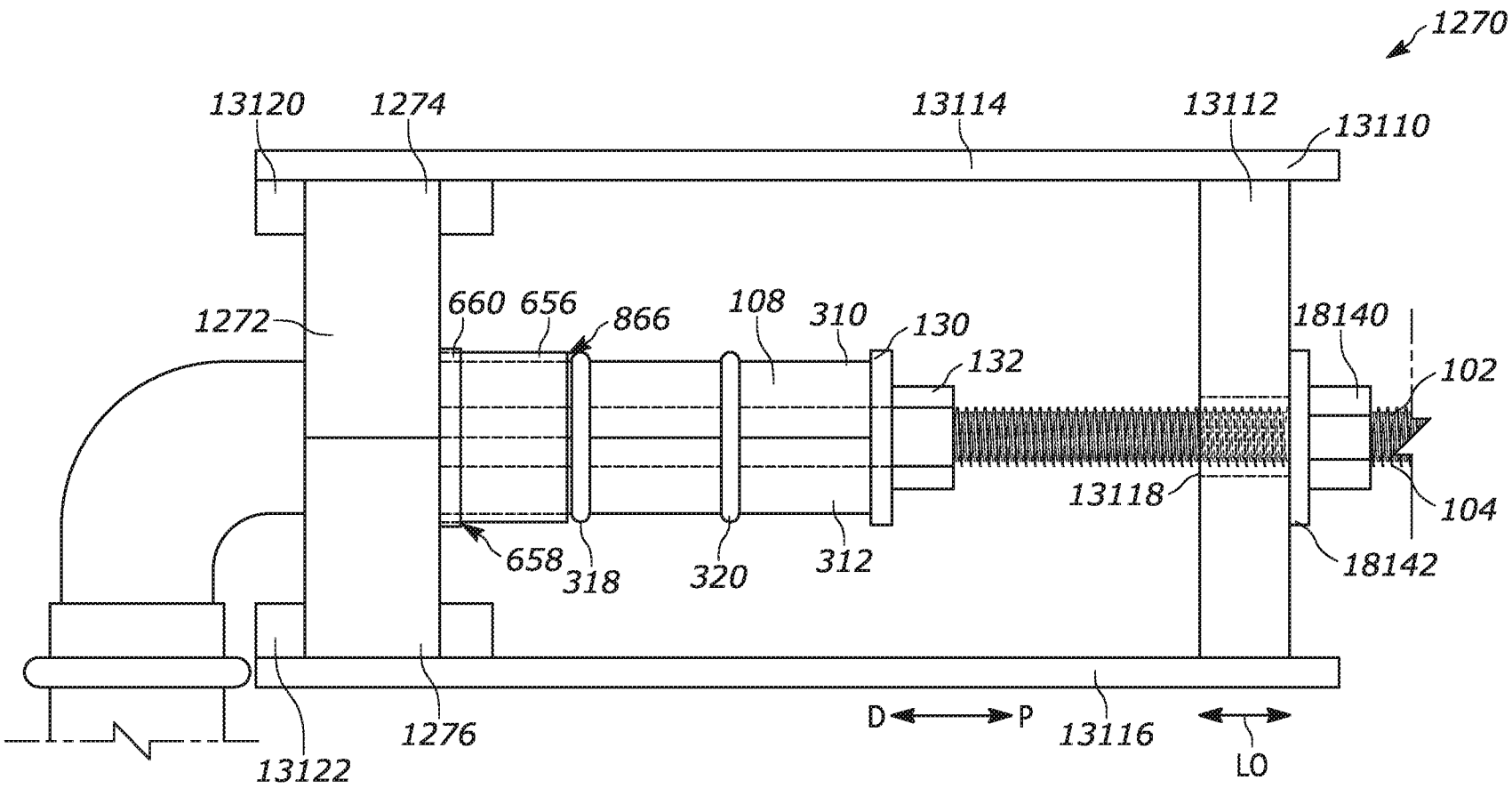

As shown in FIG. 18, the yoke 13110 is then attached to the shaft 102 by longitudinally inserting the shaft through the yoke opening 13118. The yoke 13110 is also attached to the clamp 1272 by positioning the first and second clamp plates 1274, 1276 in the first and second clamp grips 13120, 13122. A yoke nut 18140 is then threadedly attached on the threaded portion 104 of the shaft 102 adjacent to the yoke opening 13118. As shown in FIG. 18, a washer 18142 can also be attached to the shaft 102 and positioned longitudinally between the yoke nut 18140 and the yoke body 13112 to spread forces evenly across the yoke body. The yoke nut 18140 is tightened on the threaded portion 104 of the shaft 102 against the yoke body 13112. Because the yoke 13110 is prevented from longitudinally moving in the distal direction D by the clamp 1272, which in turn is prevented from longitudinally moving in the distal direction by the radial projection 662 of the pipe fitting 660, tightening the yoke nut 18140 causes the exertion of a force on the shaft 102 that longitudinally urges the shaft, along with the sleeve 108, the sleeve nut 132, and the washer 130 connected thereto, in the proximal direction P. The interference fit between the sleeve 108 and the pipe 656 causes the pipe to be pulled from the pipe fitting 660 as the shaft 102 is urged in the proximal direction P.

Figure 19:
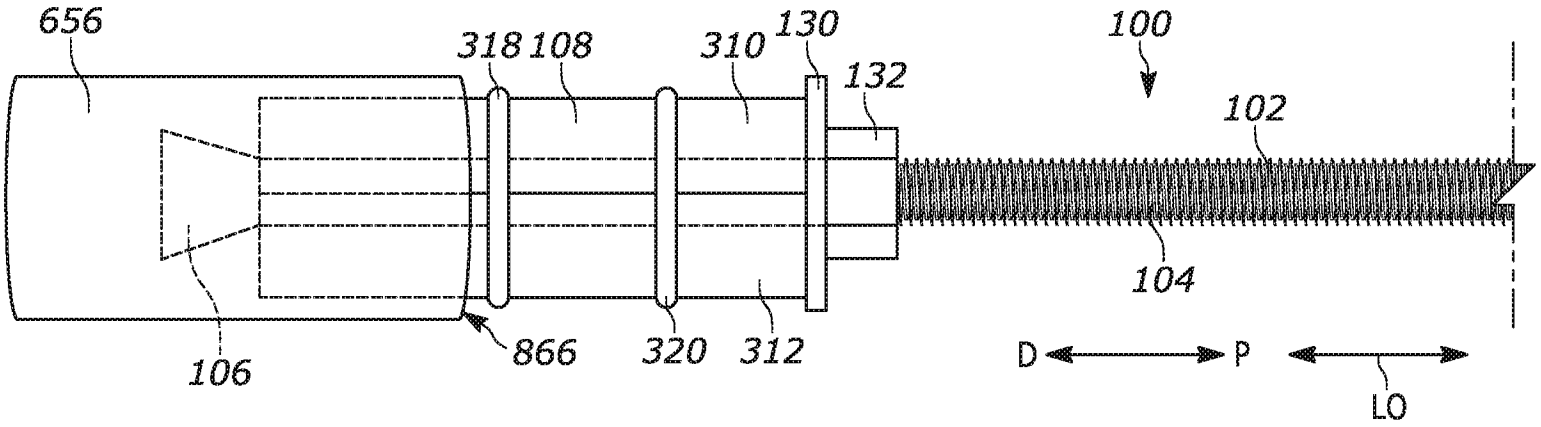

As shown in FIG. 19, the shaft 102 and the pipe 656 connected thereto are then removed from the yoke 13110 by removing the yoke nut 18140 from the shaft, and sliding the shaft in the distal direction D out from the yoke opening 13118. Once the pipe 656 and shaft 102 are removed, the pipe fitting 660 can be swaged for reuse if desired. Prior to swaging, any o-ring located within the radial projection 662 may be removed from the radial projection and inspected for damage, then re-placed as desired, or a different o-ring could be provided.

Figure 20:
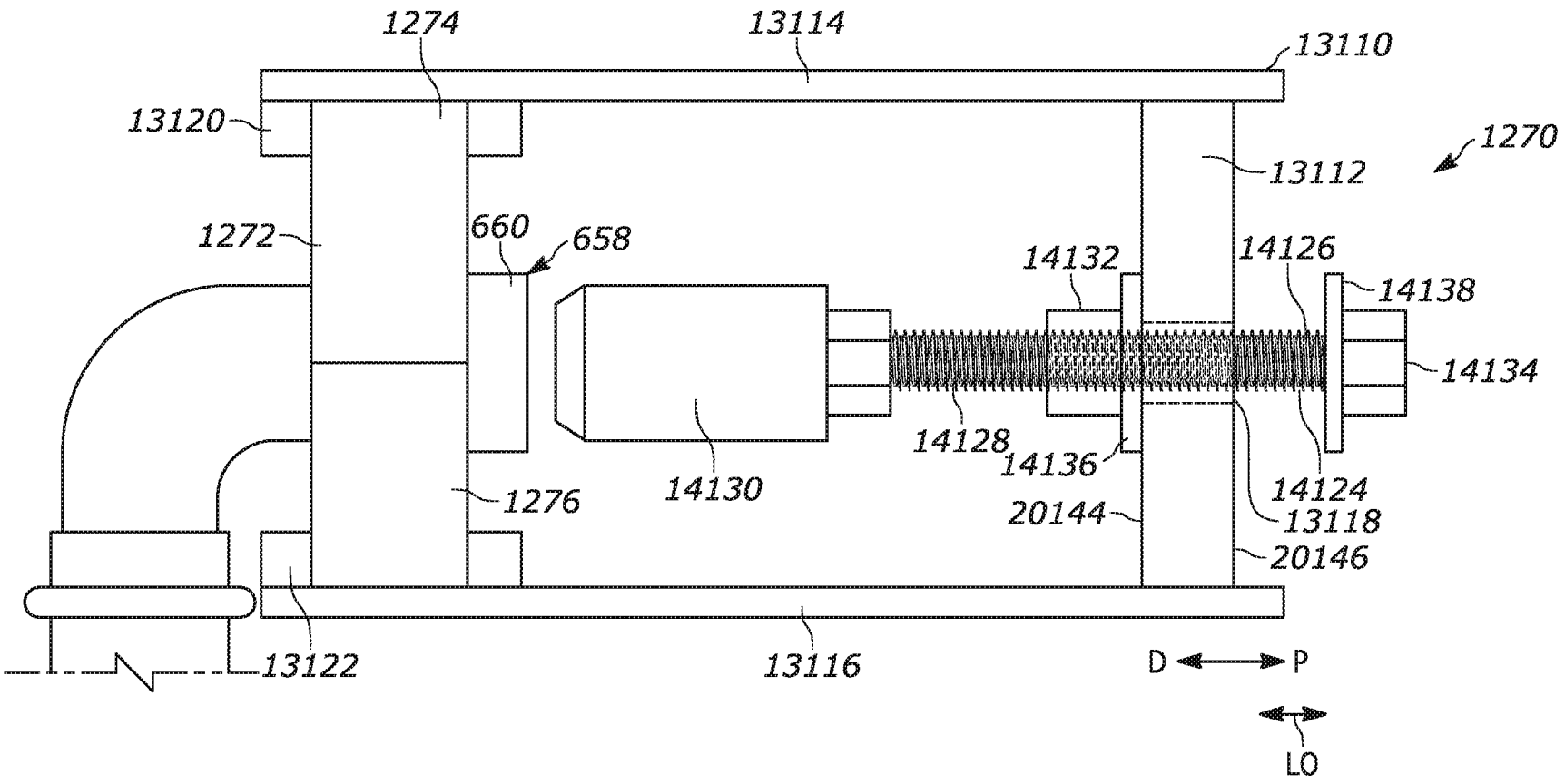

The first swage nut 14132 is threadedly attached to the threaded portion 14128 of the swage shaft 14126. The swage shaft 14126, with the first swage nut 14132 attached thereto, is longitudinally inserted through the yoke opening 13118 in the proximal direction P. As shown in FIG. 20, the first swage nut 14132 is positioned adjacent to a distal end 20144 of the yoke body 13112. A washer 14136 can also be attached to the threaded portion 14128 of the swage shaft 14126 between the first swage nut 14132 and the distal end 20144 of the yoke body 13112. The second swage nut 14134 can be threadedly attached to the threaded portion 14128 of the swage shaft 14126 longitudinally proximal to a proximal end 20146 of the yoke body 13112. As shown in FIG. 20, a washer 14138 can be attached to the threaded portion 14128 of the swage shaft 14126 between the second swage nut 14134 and the proximal end 20146 of the yoke body 13112. Placement of the first and second swage nuts 14132, 14134, and associated washers 14136, 14138 when provided, on opposite sides of the yoke body 13112 helps to maintain the swage tool 14124 in connection with the yoke 13110.

Once the swage tool 14124 is attached to the yoke 13110, the swage shaft 14126 can be positioned so that the swage end 14130 is adjacent to a distal open end 658 of the pipe fitting 660. The first swage nut 14132 is then tightened on the threaded portion 14128 of the swage shaft 14126 against the distal end 20144 of the yoke body 13112. The tightening of the first swage nut 14132 causes the exertion of a force on the swage shaft 14126 that longitudinally urges the swage shaft in the distal direction D and the swage end 14130 into the distal open end 658 of the pipe fitting 660. The swage end 14130 swages the distal open end 658 of the pipe fitting 660 as the swage end is urged into the distal open end of the pipe fitting. The swage end 14130 can be urged into the distal open end 658 of the pipe fitting 660 until the pipe fitting is swaged.

After the pipe fitting 660 is swaged, the second swage nut 14134 can be positioned adjacent to the proximal end 20146 of the yoke body 13112. The second swage nut 14134 is then tightened on the threaded portion 14128 of the swage shaft 14126 against the proximal end 20146 of the yoke body 13112. Because the yoke 13110 is prevented from longitudinally moving in the distal direction D, tightening the second swage nut 14134 causes the exertion of a force on the swage shaft 14126 that longitudinally urges the swage shaft in the proximal direction P. The swage end 14130 is pulled from the distal open end 658 of the pipe fitting 660 as the swage shaft 14126 is urged in the proximal direction P. After pulling the swage end 14130 from the pipe fitting 660, the yoke 13110, the clamp 1272, and the swage tool 14124 can be disassembled and removed from the pipe fitting 660. The o-ring can be reinserted into the radial projection 662, if desired, or a new, replacement o-ring can be inserted into the radial projection 662. With the pipe fitting 660 swaged and the o-ring in place, the pipe fitting can be reused as desired.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. A "predetermined" status may be determined at any time before the structures being manipulated actually reach that status, the "predetermination" being made as late as immediately before the structure achieves the predetermined status. The term "substantially" is used herein to indicate a quality that is largely, but not necessarily wholly, that which is specified—a "substantial" quality admits of the potential for some relatively minor inclusion of a non-quality item. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

I claim:

1. A system for manipulating a pipe joint, the system comprising:

an apparatus for disassembling the pipe joint, the apparatus including a shaft having a threaded portion longitudinally proximal to an outwardly tapered distal end, a radially expandable sleeve configured to be inserted into a distal end of a pipe of the pipe joint, the radially expandable sleeve defining a longitudinally oriented lumen through which the shaft extends, and a sleeve nut threadedly attached to the threaded portion of the shaft adjacent to a proximal end of the sleeve, selective rotation of the sleeve nut relative to the shaft tightening the sleeve nut on the threaded portion of the shaft against the sleeve and thereby urging the sleeve to longitudinally slide along the tapered distal end of the shaft, the sleeve radially expanding as the sleeve longitudinally slides along the tapered distal end of the shaft, the sleeve having an interference fit with the pipe when expanded;

a clamp having first and second clamp plates, the clamp having at least one clamp opening configured to hold a pipe fitting of the pipe joint, the at least one clamp opening being defined by associated clamping surfaces on the first and second plates;

a yoke having opposing first and second yoke arms and a yoke body interconnecting the first and second yoke arms, the first yoke arm having a first clamp grip configured to hold the first clamp plate, the second yoke arm having a second clamp grip configured to hold the second clamp plate, the yoke body having a yoke opening through which the shaft is inserted; and a yoke nut threadedly engaged to the threaded portion of the shaft adjacent the yoke opening, selective tightening of the yoke nut on the threaded portion of the shaft against the yoke body longitudinally urging the shaft, and the sleeve and sleeve nut when connected thereto, in a proximal direction.

2. The system of claim 1, wherein the sleeve is formed from a plurality of arcuate wedges, the plurality of arcuate wedges cooperatively defining the lumen, the tapered distal end of the shaft urging the plurality of arcuate wedges to move radially away from a sleeve axis as the sleeve longitudinally slides in a distal direction along the distal end of the shaft, the sleeve radially expanding as the plurality of arcuate wedges move radially away from the sleeve axis.

3. The system of claim 2, wherein the arcuate wedges cooperatively define the lumen to be outwardly tapered from the proximal end of the sleeve to a distal end of the sleeve such that a diameter of the lumen is smaller at the proximal end of the sleeve than at the distal end of the sleeve.

4. The system of claim 2, wherein the sleeve includes a biasing member extending around an outer surface of the sleeve to bias the plurality of arcuate wedges mutually together, the tapered distal end of the shaft urging the plurality of arcuate wedges radially away from the sleeve axis against the bias of the biasing member.

5. The system of claim 1, wherein the clamp has a groove that radially extends into the first and second clamp plates from the clamping surfaces, the groove being configured to hold a radial projection of the pipe fitting.

6. A method for manipulating a pipe joint, the method comprising:

providing the system of claim 1;

inserting the sleeve into a distal open end of a pipe of the pipe joint;

after inserting the sleeve into the distal open end of the pipe, rotating the sleeve nut relative to the shaft to tighten the sleeve nut on the threaded portion of the shaft against the sleeve and thereby urge the sleeve to longitudinally slide along the tapered distal end of the shaft in a distal direction, the sleeve radially expanding as the sleeve slides in the distal direction along the tapered distal end of the shaft;

radially expanding the sleeve until an interference fit is formed between the sleeve and the pipe; and once the sleeve and pipe have an interference fit, exerting a force upon the shaft to urge the shaft in a proximal direction and remove the pipe from a pipe fitting of the pipe joint.

7. The method of claim 6, further comprising:

after removing the pipe from the pipe fitting, loosening the sleeve nut on the threaded portion of the shaft to permit the sleeve to longitudinally slide along the tapered distal end of the shaft in the proximal direction, the sleeve radially contracting as the sleeve slides in the proximal direction along the tapered distal end of the shaft;

with the sleeve radially contracted, removing the sleeve from the distal open end of the pipe;

with the sleeve removed from the distal open end of the pipe, inserting the sleeve into a distal open end of the pipe fitting;

after inserting the sleeve into the distal open end of the pipe fitting, rotating the sleeve nut relative to the shaft to tighten the sleeve nut on the threaded portion of the shaft against the sleeve and thereby urge the sleeve to longitudinally slide along the tapered distal end of the shaft in the distal direction, the sleeve radially expanding as the sleeve slides in the distal direction along the tapered distal end of the shaft; and radially expanding the sleeve in the pipe fitting until the pipe fitting is swaged.

8. The method of claim 6, further comprising:

positioning the clamping surfaces of the first and second clamp plates about the pipe fitting to position the pipe fitting within the clamp opening; and securing the first clamp plate to the second clamp plate to maintain the pipe fitting in the clamp opening.

9. The method of claim 8, further comprising:

longitudinally inserting the shaft through the yoke opening;

positioning the first clamp plate in the first clamp grip to hold the first clamp plate;

positioning the second clamp plate in the second clamp grip to hold the second clamp plate;

threadedly attaching the yoke nut on the threaded portion of the shaft adjacent to the yoke opening; and tightening the yoke nut on the threaded portion of the shaft against the yoke body to cause the exertion of the force upon the shaft that longitudinally urges the shaft, and the sleeve and sleeve nut when connected thereto, in the proximal direction, the pipe being pulled from the pipe fitting as the shaft is urged in the proximal direction.

10. The method of claim 9, where the system further comprises a swage tool having a swage shaft and first and second swage nuts, the swage shaft having a threaded portion longitudinally proximal to a cylindrical swage end, the cylindrical swage end being configured to swage the pipe fitting, the method further comprising:

threadedly attaching the first swage nut on the threaded portion of the swage shaft;

after removing the pipe from the pipe fitting, removing the shaft from the yoke opening;

after removing the shaft from the yoke opening, inserting the swage shaft, with the first swage nut threadedly attached thereto, through the yoke opening;

positioning the swage shaft and first swage nut so that the first swage nut is adjacent to a distal end of the yoke body;

positioning the swage shaft so that the cylindrical swage end is adjacent to a distal open end of the pipe fitting;

with the cylindrical swage end adjacent to the distal open end of the pipe fitting, tightening the first swage nut on the threaded portion of the swage shaft against the distal end of the yoke body to cause the exertion of a force on the swage shaft that longitudinally urges the swage shaft in the distal direction and the cylindrical swage end into the distal open end of the pipe fitting, the distal open end of the pipe fitting being swaged as the cylindrical swage end is urged into the distal open end of the pipe fitting;

swaging the distal open end of the pipe fitting;

threadedly attaching the second swage nut on the threaded portion of the swage shaft;

positioning the second swage nut adjacent to a proximal end of the yoke body; and after the pipe fitting is swaged, tightening the second swage nut on the threaded portion of the swage shaft against the proximal end of the yoke body to cause the exertion of a force on the swage shaft that longitudinally urges the swage shaft in the proximal direction, the cylindrical swage end being pulled from the distal open end of the pipe fitting as the swage shaft is urged in the proximal direction.

11. A system for manipulating a pipe joint, the system comprising: an apparatus for disassembling the pipe joint, the apparatus including a shaft having a threaded portion longitudinally proximal to an outwardly tapered distal end, a radially expandable sleeve configured to be inserted into a distal end of a pipe of the pipe joint, the radially expandable sleeve defining a longitudinally oriented lumen through which the shaft extends, and a sleeve nut threadedly attached to the threaded portion of the shaft adjacent to a proximal end of the sleeve, selective rotation of the sleeve nut relative to the shaft tightening the sleeve nut on the threaded portion of the shaft against the sleeve and thereby urging the sleeve to longitudinally slide along the tapered distal end of the shaft, the sleeve radially expanding as the sleeve longitudinally slides along the tapered distal end of the shaft, the sleeve having an interference fit with the pipe when expanded;

a clamp having first and second clamp plates, the clamp having at least one clamp opening configured to hold a pipe fitting of the pipe joint, the at least one clamp opening being defined by associated clamping surfaces on the first and second plates;

a yoke having opposing first and second yoke arms and a yoke body interconnecting the first and second yoke arms, the first yoke arm having a first clamp grip configured to hold the first clamp plate, the second yoke arm having a second clamp grip configured to hold the second clamp plate, the yoke body having a yoke opening; and a swage tool including a swage shaft configured to be selectively inserted through the yoke opening, the swage shaft having a threaded portion longitudinally proximal to a cylindrical swage end, the cylindrical swage end being configured to swage the pipe fitting, a first swage nut selectively threadedly attached to the threaded portion of the swage shaft distal of the yoke body, selective tightening of the first swage nut on the threaded portion of the swage shaft against a distal end of the yoke body longitudinally urging the swage shaft in a distal direction, and a second swage nut selectively threadedly attached to the threaded portion of the swage shaft proximal to the yoke body, selective tightening of the second swage nut on the threaded portion of the swage shaft against a proximal end of the yoke body longitudinally urging the swage shaft in a proximal direction.

12. The system of claim 11, wherein the sleeve is formed from a plurality of arcuate wedges, the plurality of arcuate wedges cooperatively defining the lumen, the tapered distal end of the shaft urging the plurality of arcuate wedges to move radially away from a sleeve axis as the sleeve longitudinally slides in a distal direction along the distal end of the shaft, the sleeve radially expanding as the plurality of arcuate wedges move radially away from the sleeve axis.

13. The system of claim 12, wherein the arcuate wedges cooperatively define the lumen to be outwardly tapered from the proximal end of the sleeve to a distal end of the sleeve such that a diameter of the lumen is smaller at the proximal end of the sleeve than at the distal end of the sleeve.

14. The system of claim 12, wherein the sleeve includes a biasing member extending around an outer surface of the sleeve to bias the plurality of arcuate wedges mutually together, the tapered distal end of the shaft urging the plurality of arcuate wedges radially away from the sleeve axis against the bias of the biasing member.

15. The system of claim 11, further comprising a housing having a proximal opening configured to selectively receive the shaft, an interior space of the housing longitudinally extending from the proximal opening to a distal end of the housing, and at least a portion of the shaft, sleeve, and sleeve nut being selectively located within the interior space.

16. The system of claim 15, further comprising a housing nut selectively threadedly attached to the threaded portion of the shaft adjacent the proximal opening of the housing, selective tightening of the housing nut on the threaded portion of the shaft against the housing longitudinally urging the shaft, and the sleeve and sleeve nut when attached thereto, in a proximal direction.

17. A method for manipulating a pipe joint, the method comprising:

providing the system of claim 11;

inserting the sleeve into a distal open end of a pipe of the pipe joint;

after inserting the sleeve into the distal open end of the pipe, rotating the sleeve nut relative to the shaft to tighten the sleeve nut on the threaded portion of the shaft against the sleeve and thereby urge the sleeve to longitudinally slide along the tapered distal end of the shaft in a distal direction, the sleeve radially expanding as the sleeve slides in the distal direction along the tapered distal end of the shaft;

radially expanding the sleeve until an interference fit is formed between the sleeve and the pipe; and once the sleeve and pipe have an interference fit, exerting a force upon the shaft to urge the shaft in a proximal direction and remove the pipe from a pipe fitting of the pipe joint.

18. The method of claim 17, further comprising:

after removing the pipe from the pipe fitting, loosening the sleeve nut on the threaded portion of the shaft to permit the sleeve to longitudinally slide along the tapered distal end of the shaft in the proximal direction, the sleeve radially contracting as the sleeve slides in the proximal direction along the tapered distal end of the shaft;

with the sleeve radially contracted, removing the sleeve from the distal open end of the pipe;

with the sleeve removed from the distal open end of the pipe, inserting the sleeve into a distal open end of the pipe fitting;

after inserting the sleeve into the distal open end of the pipe fitting, rotating the sleeve nut relative to the shaft to tighten the sleeve nut on the threaded portion of the shaft against the sleeve and thereby urge the sleeve to longitudinally slide along the tapered distal end of the shaft in the distal direction, the sleeve radially expanding as the sleeve slides in the distal direction along the tapered distal end of the shaft; and radially expanding the sleeve in the pipe fitting until the pipe fitting is swaged.

19. The method of claim 17, wherein the system further comprises a housing and a housing nut, the housing having a proximal opening and an interior space longitudinally extending from the proximal opening to a distal end of the housing, the method further comprising:

longitudinally inserting the shaft through the interior space and proximal opening of the housing;

positioning the housing so that the distal end of the housing engages a radial projection on the pipe fitting, at least a portion of the shaft, sleeve, and sleeve nut being selectively located within the interior space when the distal end of the housing engages the projection on the pipe fitting;

threadedly attaching the housing nut on the threaded portion of the shaft adjacent to the proximal opening of the housing; and tightening the housing nut on the threaded portion of the shaft against the housing to cause the exertion of the force upon the shaft that longitudinally urges the shaft, and the sleeve and sleeve nut when connected thereto, in the proximal direction, the pipe being pulled from the pipe fitting as the shaft is urged in the proximal direction.

20. The method of claim 17, further comprising:

positioning the clamping surfaces of the first and second clamp plates about the pipe fitting to position the pipe fitting within the clamp opening; and securing the first clamp plate to the second clamp plate to maintain the pipe fitting in the clamp opening;

longitudinally inserting the shaft through the yoke opening;

positioning the first clamp plate in the first clamp grip to hold the first clamp plate;

positioning the second clamp plate in the second clamp grip to hold the second clamp plate;

threadedly attaching a yoke nut on the threaded portion of the shaft adjacent to the yoke opening; and tightening the yoke nut on the threaded portion of the shaft against the yoke body to cause the exertion of the force upon the shaft that longitudinally urges the shaft, and the sleeve and sleeve nut when connected thereto, in the proximal direction, the pipe being pulled from the pipe fitting as the shaft is urged in the proximal direction;

threadedly attaching the first swage nut on the threaded portion of the swage shaft;

after removing the pipe from the pipe fitting, removing the shaft from the yoke opening;

after removing the shaft from the yoke opening, inserting the swage shaft, with the first swage nut threadedly attached thereto, through the yoke opening;

positioning the swage shaft and first swage nut so that the first swage nut is adjacent to a distal end of the yoke body;

positioning the swage shaft so that the cylindrical swage end is adjacent to a distal open end of the pipe fitting;

with the cylindrical swage end adjacent to the distal open end of the pipe fitting, tightening the first swage nut on the threaded portion of the swage shaft against the distal end of the yoke body to cause the exertion of a force on the swage shaft that longitudinally urges the swage shaft in the distal direction and the cylindrical swage end into the distal open end of the pipe fitting, the distal open end of the pipe fitting being swaged as the cylindrical swage end is urged into the distal open end of the pipe fitting;

swaging the distal open end of the pipe fitting;

threadedly attaching the second swage nut on the threaded portion of the swage shaft;

positioning the second swage nut adjacent to a proximal end of the yoke body; and after the pipe fitting is swaged, tightening the second swage nut on the threaded portion of the swage shaft against the proximal end of the yoke body to cause the exertion of a force on the swage shaft that longitudinally urges the swage shaft in the proximal direction, the cylindrical swage end being pulled from the distal open end of the pipe fitting as the swage shaft is urged in the proximal direction.

* * * * *